United States Patent [19]

Blackburn, Jr. et al.

[11] 4,131,073

[45] Dec. 26, 1978

[54] BOILER FAN ARRANGEMENT

[75] Inventors: Samuel S. Blackburn, Jr., Avon; George P. Hammer, Simsbury, both of Conn.

[73] Assignee: Combustion Engineering, Inc., Windsor, Conn.

[21] Appl. No.: 847,338

[22] Filed: Oct. 31, 1977

[51] Int. Cl.[2] ..... F23L 15/00; F23K 1/04

[52] U.S. Cl. ..... 110/106; 110/304; 165/7

[58] Field of Search ..... 110/106, 302, 304; 122/DIG. 1; 165/7

[56] References Cited

U.S. PATENT DOCUMENTS

| | | | |
|---|---|---|---|
| 2,424,587 | 7/1947 | Smith et al. | 110/304 |
| 2,694,991 | 11/1954 | Marquez, Jr. | 110/302 |
| 3,273,520 | 9/1966 | Hottenstine | 110/106 |
| 3,799,242 | 3/1974 | Harris et al. | 110/304 |

*Primary Examiner*—Kenneth W. Sprague
*Attorney, Agent, or Firm*—Wayne H. Lang

[57] ABSTRACT

An arrangement for supplying air to a boiler-furnace whereby an axial flow fan being used as a source of primary air may selectively take suction air from the atmosphere or from the discharge side of a fan being used to provide secondary air to the boiler. This arrangement will provide an increased inlet pressure for the primary air fan to thereby achieve increased stability and high system pressure for low load operation, thereby permitting the effective use of an axial flow fan as a source of primary air when such usage would otherwise be unjustified.

5 Claims, 1 Drawing Figure

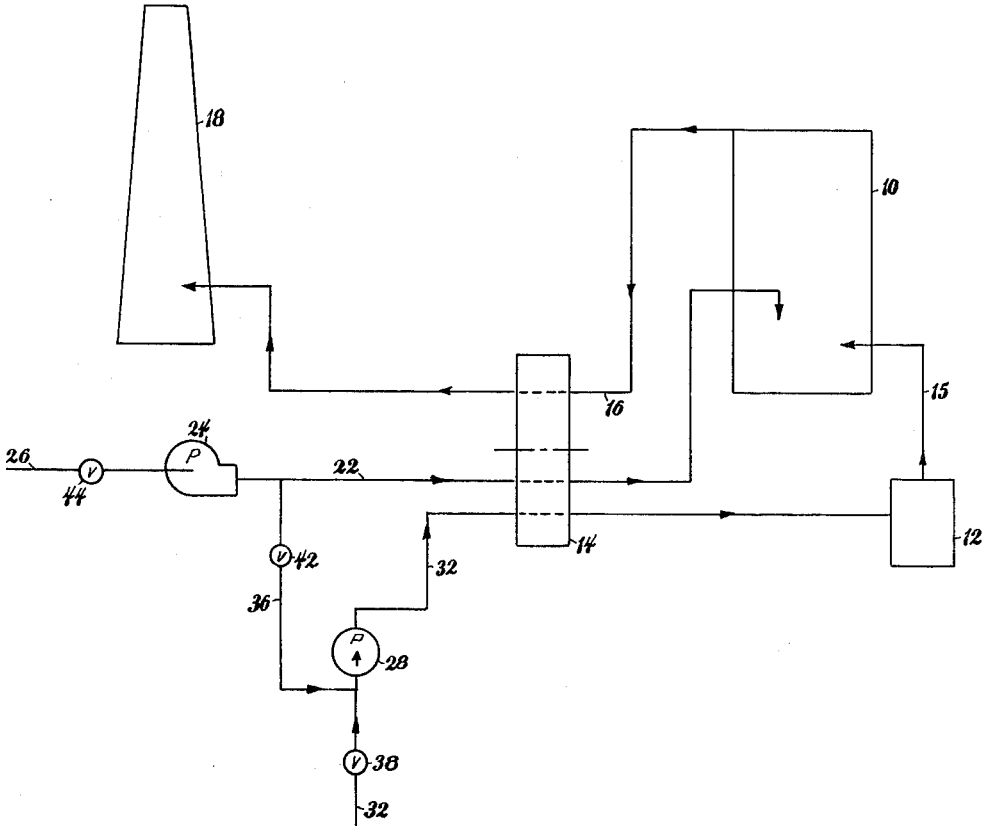
18
10
16
15
24
P
26
V
44
22
14
12
V
42
32
36
P
28
V
38
32

BOILER FAN ARRANGEMENT

BACKGROUND OF THE INVENTION

In the operation of a boiler system, fans generally consume more power than any other station auxiliary. Inasmuch as fuel costs have risen sharply in recent years, and the costs of boiler operation depend to a large extent upon the costs of operating the fans, the costs of plant operation have had a corresponding rise.

Recognizing this, most utilities have taken a hard look at how fan energy may be conserved and the costs of boiler operation may be accordingly lowered. As a result, axial flow fans have been found to consume much less power than centrifugal units when operated under conditions commonly encountered in central power stations. Although the first cost of a centrifugal unit may be less than that of an axial flow unit, and although various other advantages of output, service, and control may be attributed to units of the centrifugal type, the fact remains that a significant power savings may be realized through the use of an axial flow primary air fan instead of a centrifugal fan of the usual type. Inasmuch as axial flow fans are more economical to operate than centrifugal fans, it becomes an object of this invention to provide an arrangement that permits the effective use of an axial flow fan for the supply of primary air to a boiler-furnace.

SUMMARY OF THE INVENTION

According to the present invention there is therefore provided a system for the supply of boiler air that effectively utilizes an axial flow fan for the supply of a primary air stream while a secondary air stream is continuously supplied by a conventional forced draft fan. The fans are adapted to operate in a parallel mode under conditions of high loading, but when the load is reduced and a region of instability is approached, operation is transferred to a series mode wherein suction for the axial flow primary air fan is taken from the discharge side of the forced draft fan, thereby supplementing the outlet pressure of the axial flow fan.

BRIEF DESCRIPTION OF THE DRAWING

A more complete understanding of this invention may be had by reference to the accompanying drawing in which the single FIGURE is a schematic diagram of an axial flow fan in a system adapted to various load requirements.

DESCRIPTION OF THE PREFERRED EMBODIMENT

In the drawing, numeral 10 relates to a typical boiler-furnace that is provided with a quantity of coal for combustion from pulverizing and drying mill 12. The coal is carried through duct 15 to furnace 10 by a quantity of hot primary air heated in regenerative heat exchanger 14 and forced along by the fan 28. While traversing heat exchanger 14, the primary air flowing through duct 32 accordingly picks up heat from hot exhaust gases flowing through passageway 16 on their way to stack 18.

As the heat exchanger 14 is heated, it also imparts a portion of the absorbed heat to the secondary air for combustion supplied through a duct 22. The secondary air is provided by a forced draft fan 24 having its suction side 26 connected to a source of air such as the atmosphere.

Secondary air that provides air for combustion has historically been supplied by a centrifugal flow forced draft fan 24. Centrifugal flow fans for this application are specified because they have an extremely broad range of operation, they are applicable for high resistance application, and most importantly, because of their low initial cost.

Primary air that dries the coal and carries it through the mills 12 to furnace 10 is supplied by fan 28 and duct 32 to heat exchanger 14 where it is preheated in accordance with standard procedures before it becomes a carrier for the coal.

Fans 28 which pressurize the primary air before it is passed on to the heat exchanger 14 have historically been of the centrifugal type that take their suction directly from the atmosphere. Centrifugal fans are designated because they have a broad operating range, and because they may readily be adapted for the high resistance application necessary for such application.

Therefore, even though axial flow fans consume much less power than similarly sized centrifugal fans and accordingly are much more economical to operate, they are not used to supply primary air for boiler-furnaces because they are unstable at low loads and they are not suited for the high system pressure required of primary air fans.

According to this invention an arrangement is provided whereby the output pressure of an axial flow fan is substantially increased to provide stability of operation. A conventional centrifugal flow fan is arranged to direct its output of combustion air (secondary air) through an air preheater to a boiler-furnace, while primary air is simultaneously directed through the heat exchanger 14 to the pulverizing mill 12 by a fan 28. The fan 28 for primary air supply is an axial flow fan that has a suction connection to the atmosphere through line 32, and to the discharge side of centrifugal fan 24 through a line 36. Valve means 38 and 42 permit the selective use of either suction connection as desired whereby the source of air for the primary air fan may be the atmosphere or the discharge side of fan 24.

The system will be operated in a parallel mode at high loads wherein valve 42 is closed and valve 38 is open to permit independent operation of each fan in the manner presently practiced by the utility industry. When the load on the primary air fan 28 is reduced to a point where instability is approached, operation will be transferred to a series mode where valve 38 is closed and valve 42 is open to permit the taking of suction from the discharge of forced draft fan 24. This will increase the primary air fan inlet pressure, thereby supplementing the primary air fan to achieve the desired system pressure and the desired stability of operation. Simultaneously, the centrifugal flow forced draft fan 24 may be increased to supply the required quantity of primary air.

The actuation of control valves 38–42 necessary to attain the predetermined advantages of the invention may be effected manually or by automatic actuators operated in accordance with well-known procedures and in response to predetermined pressure at any of various points downstream from the pump 28.

The invention described herein and illustrated in the accompanying drawing is accordingly subject to many modifications within the ability of persons skilled in the art, and all such modifications are considered to lie within the spirit and scope of the appended claims.

We claim:

1. A system for the supply of air to a boiler-furnace requiring both primary and secondary air, a source of ambient air, an air preheater that receives air from said source and exhausts it to the boiler-furnace, a forced draft fan with suction and discharge sides thereof adapted to move the secondary air for combustion from the source to the air preheater, an axial flow fan for primary air with suction and discharge sides having the discharge side thereof connected to the air preheater, a first duct connecting the suction side of said axial flow fan to the discharge side of the forced draft fan, a second duct connecting the suction side of the axial flow fan to the source of air, and valve means controlling air flow through each of said duct means.

2. An air supply system for a boiler-furnace as defined in claim 1 wherein the forced draft fan is a centrifugal flow fan.

3. An air supply system for a boiler-furnace as defined in claim 1 wherein the forced draft fan is an axial flow fan.

4. An air supply system for a boiler-furnace as defined in claim 1 including mills that process fuel and direct said fuel to the boiler-furnace, and means directing primary air from the air preheater through the mills whereby primary air heated in the air preheater heats the fuel and transports the processed fuel to the boiler-furnace.

5. An air supply system for a boiler-furnace as defined in claim 4 including valve means in the suction side of the centrifugal fan modulating air flow to said centrifugal fan whereby the flow therethrough may be regulated to supply a required quantity of primary air.

* * * * *